US011849827B2

(12) United States Patent
Stimpfling

(10) Patent No.: US 11,849,827 B2
(45) Date of Patent: Dec. 26, 2023

(54) COSMETIC PRODUCT DISPENSING PIPETTE COMPRISING A BALL RECEIVING INSERT, AND ASSOCIATED DEVICE AND METHOD

(71) Applicant: L'OREAL, Paris (FR)

(72) Inventor: Maxim Stimpfling, Clichy (FR)

(73) Assignee: L'OREAL, Paris (FR)

( * ) Notice: Subject to any disclaimer, the term of this patent is extended or adjusted under 35 U.S.C. 154(b) by 22 days.

(21) Appl. No.: 17/627,334

(22) PCT Filed: Jul. 24, 2020

(86) PCT No.: PCT/EP2020/070940
§ 371 (c)(1),
(2) Date: Jan. 14, 2022

(87) PCT Pub. No.: WO2021/018765
PCT Pub. Date: Feb. 4, 2021

(65) Prior Publication Data

US 2022/0265025 A1 Aug. 25, 2022

(30) Foreign Application Priority Data

Jul. 26, 2019 (FR) ..... 19 08520

(51) Int. Cl.
*A45D 34/04* (2006.01)
*A45D 40/26* (2006.01)

(52) U.S. Cl.
CPC ..... *A45D 34/041* (2013.01); *A45D 40/261* (2013.01); *A45D 2200/055* (2013.01)

(58) Field of Classification Search
CPC ..... A45D 34/041; A45D 40/261; A45D 2200/05; A45D 2200/10; B05C 17/02; B05C 17/0341
USPC ..... 401/208–216, 188 R
See application file for complete search history.

(56) References Cited

U.S. PATENT DOCUMENTS 3,261,326 A * 7/1966 Ryan ..... B43K 1/08 401/216
3,781,123 A * 12/1973 Linz ..... B43K 1/084 106/31.6
4,195,941 A * 4/1980 Barlow ..... B43K 1/08 401/214

(Continued)

FOREIGN PATENT DOCUMENTS

CN 1170669 A 1/1998
CN 1191472 A 8/1998

(Continued)

*Primary Examiner* — David J Walczak
(74) *Attorney, Agent, or Firm* — POLSINELLI PC

(57) ABSTRACT

A dispensing pipette that comprises a tubular dispensing duct for dispensing a cosmetic product defining a longitudinal passage, the tubular duct having an upper end and a lower end (54), the lower end (54) defining a receiving insert (58) for receiving a ball (34), and a ball (34) rotatably mounted in the receiving insert (58), the ball (34) being designed to dispense the cosmetic product by rotation of the ball (34). The receiving insert (58) has an inner surface (60) facing the ball (34), the receiving insert (58) defining at least one longitudinal channel (70) radially withdrawn away from the ball (34) into the inner surface (60) to allow the flow of the cosmetic product around the ball (34).

19 Claims, 4 Drawing Sheets

(56) References Cited

U.S. PATENT DOCUMENTS

| | | | | | |
|---|---|---|---|---|---|
| 4,472,462 | A * | 9/1984 | Apice | D06Q 1/00 | 523/161 |
| 4,717,277 | A * | 1/1988 | Hutt | B43K 1/08 | 401/220 |
| 6,161,977 | A * | 12/2000 | Furukawa | B43K 1/084 | 401/209 |
| 2015/0257510 | A1* | 9/2015 | Kim | A45D 34/045 | 401/126 |

FOREIGN PATENT DOCUMENTS

| | | | |
|---|---|---|---|
| CN | 1784157 | A | 6/2006 |
| CN | 1795243 | A | 6/2006 |
| CN | 203555304 | U | 4/2014 |
| CN | 104703505 | A | 6/2015 |
| CN | 105188464 | A | 12/2015 |
| CN | 204908370 | U | 12/2015 |
| CN | 107487108 | A | 12/2017 |
| EP | 2 904 928 | A1 | 8/2015 |
| KR | 2014 0003260 | U | 6/2014 |

* cited by examiner

COSMETIC PRODUCT DISPENSING PIPETTE COMPRISING A BALL RECEIVING INSERT, AND ASSOCIATED DEVICE AND METHOD

CROSS REFERENCE TO RELATED APPLICATIONS

This application is a National Phase filing under 35 U.S.C. § 371 of PCT/EP2020/070940 filed on Jul. 24, 2020; which application in turn claims priority to Application No. 19 08520 filed in France on Jul. 26, 2019. The entire contents of each application are hereby incorporated by reference.

The present invention relates to a cosmetic product dispensing pipette, comprising:

a tubular dispensing duct for dispensing a cosmetic product, defining a longitudinal passage for the cosmetic product, the tubular duct having an upper end and a lower end, the lower end defining a receiving insert for receiving a ball, a ball rotatably mounted in the receiving insert, the ball being designed to come into contact with the skin of a user and to dispense the cosmetic product by rotation of the ball.

Such a pipette is for example described in document EP 2,904,928 A1. The pipette is used to withdraw a quantity of cosmetic product from a reservoir in order to store this cosmetic product in the duct of the pipette, the cosmetic product flowing around the ball from the reservoir toward the duct.

When a user wishes to apply the cosmetic product on the skin, he applies the ball against his skin and moves the pipette by rolling the ball such that the cosmetic product flows around the ball to be deposited on the skin.

Such pipettes are used to dispense a cosmetic product, for example a hair product, a hygiene product, a face care and/or body care product, a makeup product or a sun product.

A cosmetic product is more generally a product as defined in EC Regulation no. 1223/2009 by the European Parliament and Council dated Nov. 30, 2009, relative to cosmetic products.

However, such a pipette is not fully satisfactory. When the pipette suctions the cosmetic product from the reservoir, the ball tends to follow the flow of the cosmetic product and moves upward. In some cases, the upward movement of the ball blocks the duct and prevents any passage of the cosmetic product from the reservoir into the duct.

Additionally, when the user rolls the ball over the skin, the flow of the cosmetic product from the duct toward the skin tends to be blocked by the ball at the outlet of the duct, such that the dispensing of the cosmetic product becomes intermittent or stops completely.

One aim of the present invention is to allow a continuous flow of the cosmetic product between the reservoir and the pipette, both during the suctioning of the cosmetic product and during the dispensing of the cosmetic product from the pipette onto the skin.

To that end, the invention relates to a dispensing pipette of the aforementioned type, wherein the receiving insert has an inner surface facing the ball, the receiving insert defining at least one longitudinal channel radially withdrawn away from the ball into the inner surface so as to allow the flow of the cosmetic product between the lower end of the dispensing pipette and the tubular duct around the ball.

The longitudinal channel(s) allow the cosmetic product to flow continuously between the tubular duct and the outside of the pipette, irrespective of the position of the ball in the pipette relative to the tubular duct.

The pipette according to the invention may comprise one or more of the following features, considered alone or according to any technically possible combination(s):

the receiving insert defines a plurality of longitudinal channels arranged around the ball.

The presence of the plurality of longitudinal channels allows a continuous fluid communication between the tubular duct and the outside of the pipette, even if one of the longitudinal channels is blocked by the cosmetic product.

The plurality of longitudinal channels also allows a uniform distribution of the cosmetic product on the ball.

The ball is movably mounted in the receiving insert between an upper position in which the ball bears on an upper region of the inner surface of the receiving insert and a lower position in which the ball is arranged bearing on a lower region of the receiving insert and is separated from the upper region, the or each longitudinal channel passing through the upper region to allow the flow of the cosmetic product around the ball in the upper position of the ball.

When the pipette suctions the cosmetic product contained in the reservoir toward the tubular duct, the ball can bear on the upper region of the inner surface. The presence of the longitudinal channel(s) in the upper region allows the cosmetic product to continue to flow from the reservoir toward the tubular duct of the pipette.

The tubular dispensing duct is made in one integral piece.

This feature simplifies the production of the pipette and reduces the number of its components. The reduced number of components of the pipette also ensures its structural integrity.

The tubular duct comprises an upper tube and a lower ball receiving part fastened to the upper tube, the lower part defining the receiving insert, the or each longitudinal channel being arranged in the lower part.

The separation of the upper tube and the lower ball receiving part allows the possibility of changing the ball receiving part, while using the same upper tube. Thus, it is possible to standardize the manufacturing while defining specific ball shapes.

When the ball is separated from the skin of a user, the maximum play between the inner surface of the receiving insert and the ball is less than 0.5 mm.

With this small play between the tubular duct and the ball when the ball is separated from the skin of a user, the risk of cosmetic product leaking from the tubular duct toward the outside of the pipette is very limited.

The or each longitudinal channel has, in cross-section, a shape converging toward the ball.

The converging shape of the or each longitudinal channel allows the tubular duct to best grip the ball, while allowing the flow of a sufficient quantity of the cosmetic product through the or each longitudinal channel.

The invention also relates to a device for packaging and distributing a cosmetic product, comprising a reservoir containing a cosmetic product, a dispensing pipette as described above, the dispensing pipette comprising a bulb mounted on the upper end of the tubular duct.

The invention further relates to a method for dispensing a cosmetic product, including the following steps:

providing a packaging and dispensing device as described above;

suctioning the cosmetic product into the tubular duct by the bulb, the cosmetic product flowing from the reservoir toward the tubular duct around the ball through at least one longitudinal channel;

applying the ball on the skin of a user and dispensing the cosmetic product on the skin by rotation of the ball.

The method according to the invention may comprise the following feature:

When the ball occupies an upper position in which it is bearing on an upper region of the inner surface of the receiving insert, the cosmetic product flows around the ball in the upper position of the ball in the or each longitudinal channel passing through the upper region.

The invention will be better understood upon reading the following description, provided solely as an example, and done in reference to the appended drawings, in which.

The terms "upstream" and "downstream" are generally understood hereinafter relative to the normal dispensing direction of the product during use to dispense the cosmetic product on the skin.

The term "longitudinal" is to be understood as the direction in which the pipette assumes the maximum dimension, and the term "transverse" is to be understood as a direction perpendicular to the longitudinal direction. As an example, plane III-III in FIG. 1 extends substantially in the transverse direction.

Figure 1:
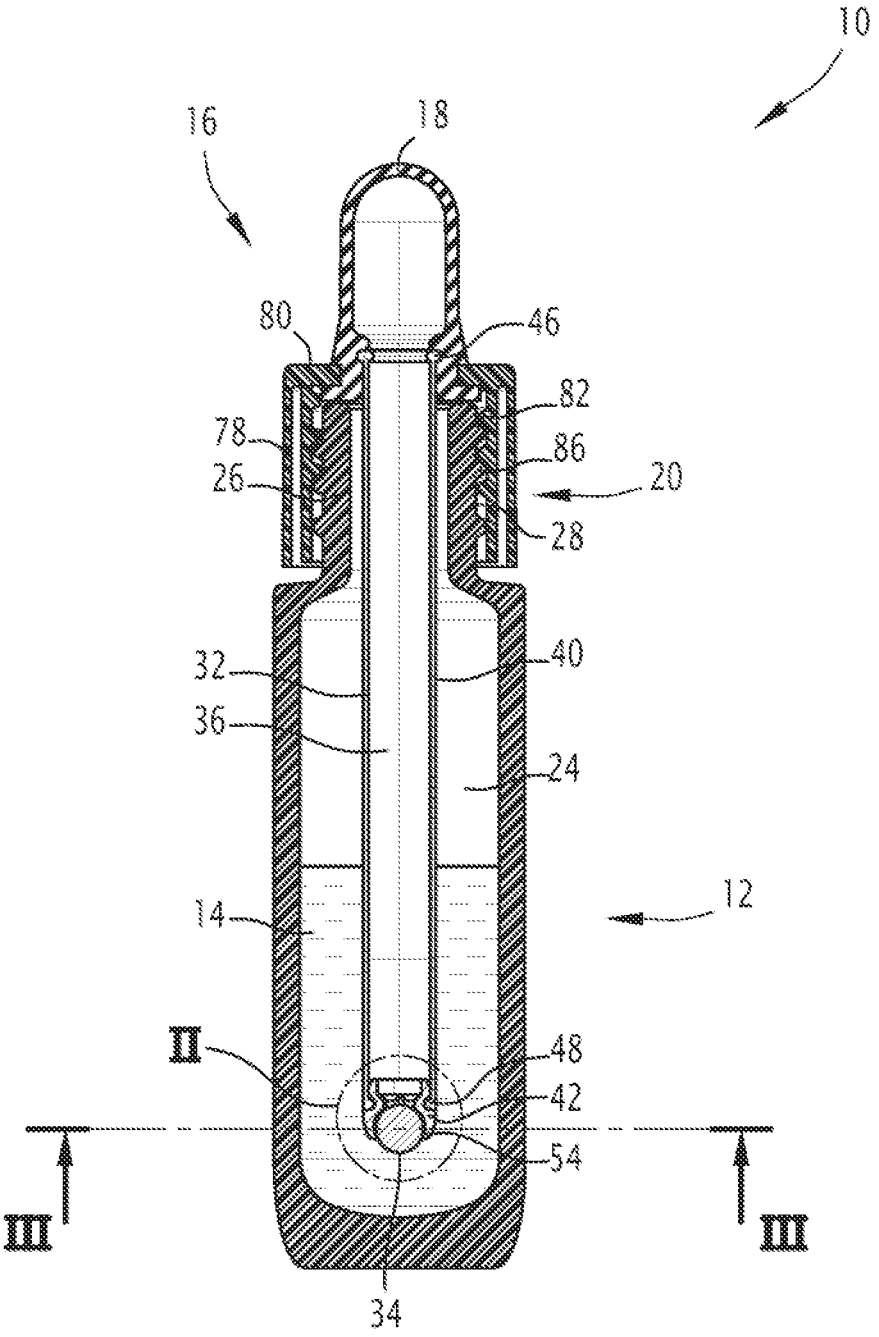
FIG. 1 is a longitudinal sectional view of a packaging device according to the invention.

A packaging and dispensing device 10 for a cosmetic product is illustrated in FIG. 1. The packaging and dispensing device 10 comprises a container 12 containing a cosmetic product 14, a dispensing pipette 16 comprising a bulb 18, and a band 20 mounted on the container 12.

The container 12 comprises a reservoir 24 receiving the cosmetic product 14 and a neck 26 defining a passage for the pipette 16. The neck 26 has an outer thread 28 arranged on its outer surface opposite the passage.

The cosmetic product 14 is contained in the container 12.

Aside from the bulb 18, the dispensing pipette 16 comprises a tubular duct 32 for dispensing cosmetic product 14, and, on either side of the tubular duct 32, a ball 34 mounted rotating relative to the tubular duct 32.

The tubular duct 32 extends along the longitudinal direction. It defines a longitudinal passage 36 for the cosmetic product 14. In the embodiment shown in the Figures, the tubular duct 32 comprises an upper tube 40 and a lower part 42 for receiving a ball downstream relative to the upper tube 40.

The upper tube 40 defines an upper end 46 and a connecting end 48 opposite the upper end 46.

The bulb 18 is fastened on the upper end 46 of the tube 40. The upper end 46 is intended to receive gas contained in the bulb 18 toward the tubular duct 32 so as to move the first cosmetic product 14 outside the tubular duct 32, or to receive gas coming from the tubular duct 32 in order to move it toward the bulb 18 in order to suction the cosmetic product 14 from the reservoir 24 toward the tubular duct 32.

Figure 2:
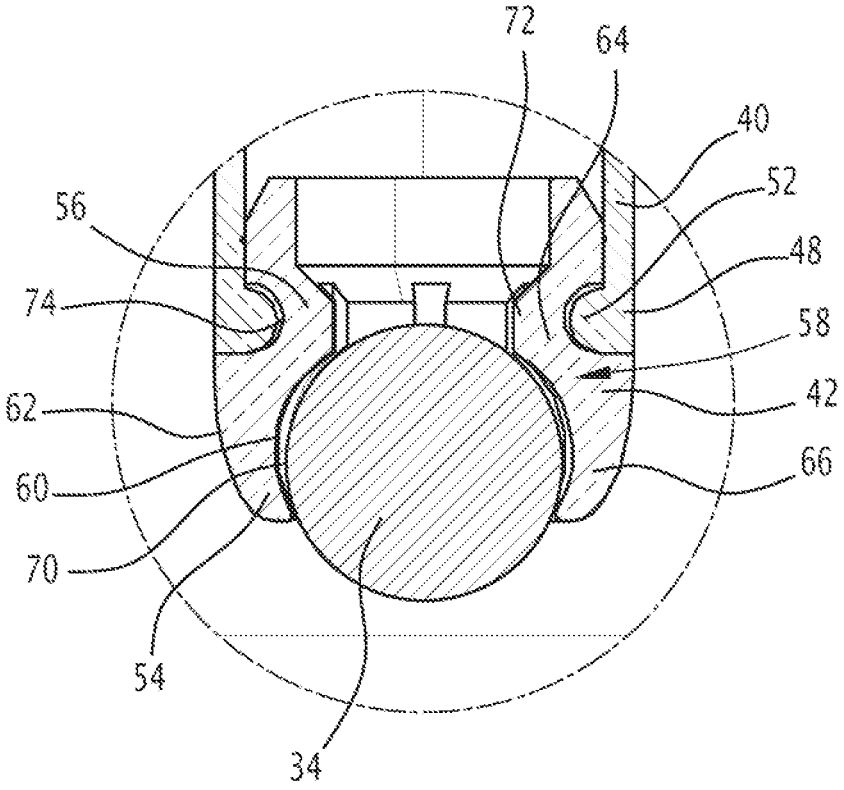
FIG. 2 is a view of a detail marked II of the lower part of the pipette of FIG. 1.

The lower part 42 is fastened to the upper tube 40 at the connecting end 48. The connecting end 48 preferably comprises, as shown in FIG. 2, a circumferential protrusion 52 protruding toward the tubular duct 32.

The lower part 42 is made from a plastic material, for example polyethylene, or polypropylene, or a thermoplastic elastomer.

The lower part 42 defines a lower end 54 and a complementary connecting head 56, located opposite the lower end 54 upstream from the latter.

The lower part 42 defines a receiving insert 58 in cap shape configured to receive the ball 34.

The receiving insert 58 has an inner surface 60 facing the ball 34 and an outer surface 62 substantially in the continuation of the upper tube 40.

The inner surface 60 comprises an upper region 64 and a lower region 66 located below the upper region 64.

The upper region 64 inwardly defines, in radial hollow, at least one longitudinal channel 70 passing longitudinally through the upper region 64. The or each longitudinal channel 70 here forms a longitudinal groove arranged in the inner surface 60. The groove emerges longitudinally at its ends and radially toward the ball 34. It is radially closed off at a distance from the ball 34. In the example illustrated in FIG. 2, each longitudinal channel 70 emerges upward above the ball 34.

The or each longitudinal channel 70 is configured to allow the cosmetic product 14 to flow around the ball 34 between the outside of the dispensing pipette 16 and the tubular duct 32, when the ball 34 is received in the receiving insert 58.

The or each longitudinal channel 70 has an angular expanse, taken around the longitudinal axis, smaller than 120°.

The upper region 64 defines an annular choke 72 protruding inwardly. The annular choke 72 has an inner diameter smaller than the diameter of the ball 34 so as to prevent the ball 34 from moving upward.

The lower region 66 has a spherical enclosure able to partially surround the ball 34. The spherical enclosure has a diameter substantially equal to the diameter of the ball 34.

In a variant, the or each longitudinal channel 70 passes through the upper 64 and lower 66 regions. The or each longitudinal channel 70 therefore passes through the entire inner surface 60.

In the example illustrated in FIG. 2, the or each longitudinal channel 70 emerges downward at the free edge of the lower region 66.

Figure 3:
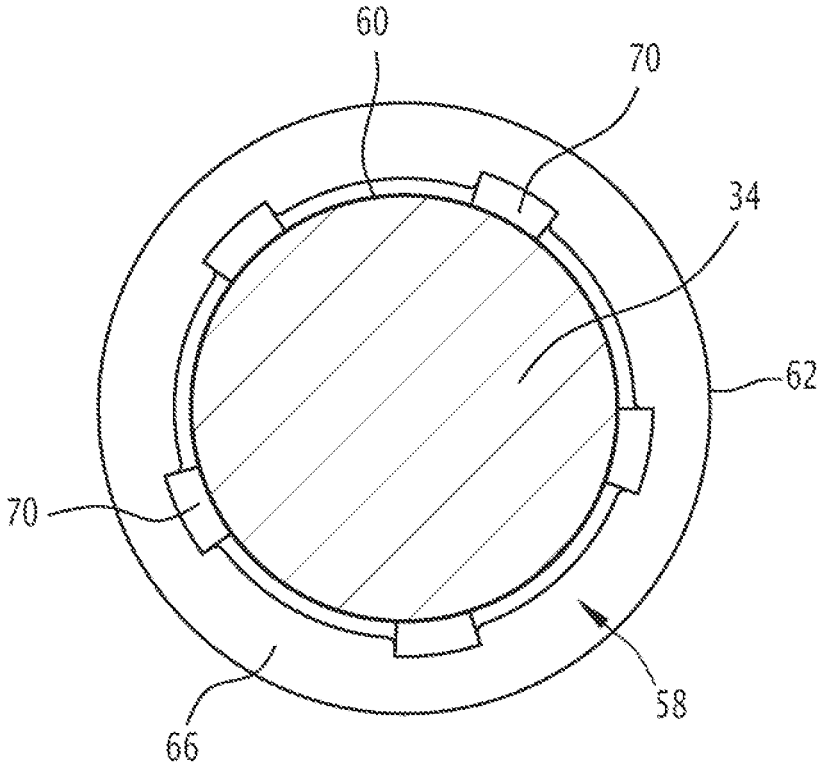
FIG. 3 is a transversal cross-sectional view along plane III-III in FIG. 1.

Advantageously, the or each longitudinal channel 70 has, in section in a transverse plane, a shape converging toward the ball 34, as shown in FIG. 3.

According to the embodiment shown in the Figures, the receiving insert 58 defines a plurality of longitudinal channels 70 arranged around the ball 34.

The complementary connecting head 56 preferably defines a circumferential groove 74 configured to cooperate with the circumferential protrusion 52 so as to fasten the lower part 42 on the upper tube 40. The circumferential groove 74 extends at least over a portion of the perimeter of the lower part 42, advantageously over the entire perimeter of the lower part 42.

The ball 34 is received in the receiving insert 58. It is designed to come into contact with the skin of a user and to dispense the cosmetic product 14 by rotation of the ball 34.

The ball 34 is advantageously made from a metal material, for example from stainless steel, or ceramic, or glass, or precious stone.

When the ball 34 is arranged separated from the skin of a user, the maximum play between the inner surface 60 of the receiving insert 58 and the ball 34 is in particular less than 0.5 mm, advantageously less than 0.25 mm. This small play allows the continuous distribution of the cosmetic product 14 on the ball 34, while limiting the leakage risk of the cosmetic product 14 from the tubular duct 32 outside the pipette 16.

The ball 34 is movable longitudinally between an upper position in which it bears on the upper region 64 of the inner surface 60 of the receiving insert 58 and a lower position in which the ball 34 is arranged bearing on the lower region 66 of the receiving insert 58 and is separated from the upper region 64. The or each longitudinal channel 70 allows the flow of the cosmetic product 14 around the ball 34 in the upper position of the ball 34.

The bulb 18 is mounted on the upper end 46 of the upper tube 40. The bulb 18 is deformable between an idle position, shown in the Figures, and a deformed position. When the bulb 18 is pressed by a user, it goes from its idle position to its deformed position and displaces the air toward the tubular duct 32.

Advantageously, during the deformation of the bulb 18 toward its deformed position, it is also able to displace part of the cosmetic product 14 present in the tubular duct 32 downward outside the tubular duct 32.

When the pressure exerted on the bulb 18 is removed by the user, the bulb 18 returns from its deformed position to its idle position and during this step, is able to suction gas contained in the tubular duct 32, and the cosmetic product 14 contained in the reservoir 24 toward the tubular duct 32.

The bulb 18 is for example made from rubber.

The band 20 comprises a peripheral wall 78 surrounding the neck 26 and a transverse wall 80 connecting the peripheral wall 78 at its upper end to the bulb 18. The band 20 also comprises an inner skirt 82 extending longitudinally from the transverse wall 80 and arranged in the peripheral wall 78.

The transverse wall 80 extends transversely relative to the longitudinal axis. It closes the band 20.

According to the embodiment shown in the Figures, the lower end of the bulb 18 is inserted between the transverse wall 80 and the upper end of the neck 26 when the band 20 is mounted on the container 12. Thus, the transverse wall 80 is kept separated from the neck 26. The bulb 18 ensures the sealing of the inside of the container 12 relative to the outside of the container 12.

The inner skirt 82 extends around the tubular duct 32. It is arranged around the neck 26 of the container 12 when the band 20 cooperates with the neck 26 of the container 12.

The inner skirt 82 defines an inner fastening surface having a complementary thread 86. When the band 20 is mounted on the container 12, the inner fastening surface 86 is arranged facing the neck 26, and the complementary thread 86 cooperates with the outer thread 28 so as to secure the pipette 16 on the neck 26.

The method for dispensing a cosmetic product 14 using a packaging and dispensing device 10 will now be described.

First, a packaging and dispensing device 12 as described above is provided.

When a user wishes to apply the cosmetic product 14 on the skin, the first turns the band 20 around the longitudinal axis. Thus, he unscrews the complementary thread 86 relative to the neck 26 outer surface 28 and separates the band 20.

Next, he pinches the bulb 18 and deforms it from its idle position toward its deformed position. The bulb 18 ejects part of the gas that it contains into the pipette 16 and thus creates an overpressure in the tubular duct 32.

Then, the user releases the pinching on the bulb 18. The cosmetic product 14 is suctioned by the bulb 18 and enters the tubular duct 32 by flowing from the reservoir 24 around the ball 34.

During the suctioning of the cosmetic product 14 by the bulb 18, the ball 34 moves upward.

The ball 34 advantageously occupies a higher position in which it bears on the upper region 64 of the inner surface 60 of the receiving insert 58. However, the cosmetic product 14 continues to enter the tubular duct 32, by flowing around the ball 34 in the upper position of the ball 34, through at least one longitudinal channel 70 due to the suction of the bulb 18.

The suctioning of the cosmetic product 14 toward the tubular duct 32 continues until the bulb 18 again occupies its idle position. A volume of cosmetic product 14 is then stored in the tubular duct 32.

When the user wishes to apply the cosmetic product 14 contained in the pipette 16 on the skin, he again pinches the bulb 18 and deforms it from its idle position to its deformed position. The cosmetic product 14 is then moved toward the outside of the pipette 16 and is distributed by the ball 34.

The movement of the cosmetic product 14 from the tubular duct 32 toward the outside thereof tends to move the ball 34 downward, that is to say, toward the lower end 54. In some cases, the ball 34 bears on the lower region 66 of the inner surface 60. Owing to the presence of the or each longitudinal channel 70, even if the ball 34 bears on the lower region 66, the cosmetic product 14 continues to flow from the tubular duct 32 through at least one longitudinal channel 70.

At the same time, the user presses the ball 34 on the skin and moves the pipette 16. The ball 34 rotates and dispenses the cosmetic product 14 on the skin.

Owing to the invention described above, the flow of the cosmetic product 14 during its suctioning from the container 12 toward the tubular duct 32 is maintained in any position of the ball 34. Indeed, even if the ball 34 presses against the upper regions 64, the presence of the longitudinal channel(s) 70 ensures a continuous flow of the cosmetic product 14 from bottom to top.

Similarly, the flow of the cosmetic product 14 from the tubular duct 32 onto the skin of a user is also provided by the longitudinal channel(s) 70.

Advantageously, the upper tube 40 is made from glass.

Figure 4:
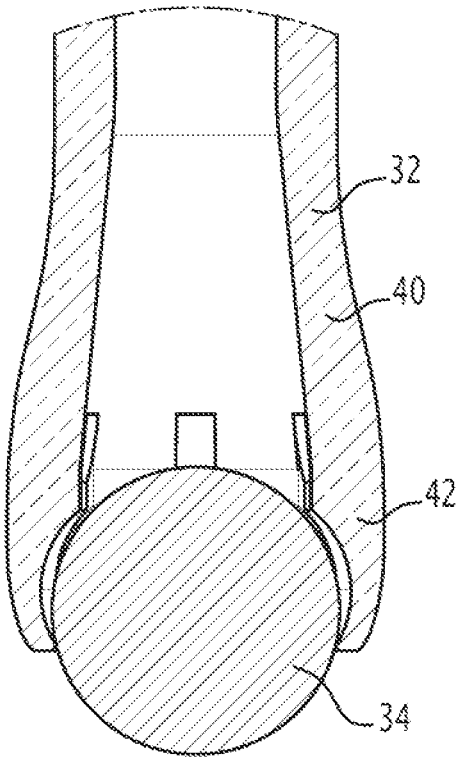
FIG. 4 is a view of a detail of the lower part of the pipette according to a variant of the packaging device of FIGS. 1 to 3.

According to a variant, shown in FIG. 4, the tubular dispensing duct 32 is made in one integral piece. Thus, the tubular duct 32 is made in a single component, and is devoid of upper tube 40 and lower part 42 attached on the upper tube 40. The tubular duct 32 defines the upper end 46 and the lower end 54.

Thus, the lower part 42 and the upper tube 40 are made in a single piece to form the tubular duct 32. The lower part 42 and the upper tube 40 are then advantageously formed by a plastic material.

The invention claimed is:

1. A dispensing pipette for a cosmetic product, comprising:

a tubular dispensing duct for dispensing a cosmetic product, defining a longitudinal passage for the cosmetic product, the tubular duct having an upper end and a lower end, the lower end defining a receiving insert for receiving a ball, and a ball rotatably mounted in the receiving insert, the ball being designed to come into contact with the skin of a user and to dispense the cosmetic product by rotation of the ball;

wherein the receiving insert has an inner surface facing the ball, the receiving insert defining at least one longitudinal channel radially withdrawn away from the ball into the inner surface so as to allow the flow of the cosmetic product between the lower end of the dispensing pipette and the tubular duct around the ball; and wherein the or each longitudinal channel has, in cross-section in a traverse plane, a shape converging toward the ball.

2. The dispensing pipette according to claim 1, wherein the receiving insert defines a plurality of longitudinal channels arranged around the ball.

3. The dispensing pipette according to claim 2, wherein the ball is movably mounted in the receiving insert between an upper position in which the ball bears on an upper region of the inner surface of the receiving insert and a lower position in which the ball is arranged bearing on a lower region of the receiving insert and is separated from the upper region, the or each longitudinal channel passing through the upper region to allow the flow of the cosmetic product around the ball in the upper position of the ball.

4. The dispensing pipette according to claim 2, wherein the tubular dispensing duct is made in one integral piece.

5. The dispensing pipette according to claim 2, wherein the tubular duct comprises an upper tube and a lower ball receiving part fastened to the upper tube, the lower part-defining the receiving insert, the or each longitudinal channel being arranged in the lower part.

6. The dispensing pipette according to claim 2, wherein the or each longitudinal channel has, in cross-section, a shape converging toward the ball.

7. The dispensing pipette according to claim 1, wherein the ball is movably mounted in the receiving insert between an upper position in which the ball bears on an upper region of the inner surface of the receiving insert and a lower position in which the ball is arranged bearing on a lower region of the receiving insert and is separated from the upper region, the or each longitudinal channel passing through the upper region to allow the flow of the cosmetic product around the ball in the upper position of the ball.

8. The dispensing pipette according to claim 7, wherein, when the ball is separated from the skin of a user, the maximum play between the inner surface of the receiving insert and the ball is less than 0.5 mm.

9. The dispensing pipette according to claim 7, wherein the tubular dispensing duct is made in one integral piece.

10. The dispensing pipette according to claim 7, wherein the tubular duct comprises an upper tube and a lower ball receiving part fastened to the upper tube, the lower part-defining the receiving insert, the or each longitudinal channel being arranged in the lower part.

11. The dispensing pipette according to claim 7, wherein the or each longitudinal channel has, in cross-section, a shape converging toward the ball.

12. The dispensing pipette according to claim 1, wherein the tubular dispensing duct is made in one integral piece.

13. The dispensing pipette according to claim 12, wherein, when the ball is separated from the skin of a user, the maximum play between the inner surface of the receiving insert and the ball is less than 0.5 mm.

14. The dispensing pipette according to claim 1, wherein the tubular duct comprises an upper tube and a lower ball receiving part fastened to the upper tube, the lower part defining the receiving insert, the or each longitudinal channel being arranged in the lower part.

15. The dispensing pipette according to claim 14, wherein, when the ball is separated from the skin of a user, the maximum play between the inner surface of the receiving insert and the ball is less than 0.5 mm.

16. A packaging and dispensing device for a cosmetic product, comprising a reservoir (24) containing a cosmetic product, a dispensing pipette according to claim 1, the dispensing pipette comprising a bulb mounted on the upper end of the tubular duct.

17. A method for dispensing a cosmetic product, comprising the following steps:

providing a packaging and dispensing device according to claim 16, suctioning the cosmetic product into the tubular duct by the bulb, the cosmetic product flowing from the reservoir toward the tubular duct around the ball through at least one longitudinal channel, applying the ball on the skin of a user and dispensing the cosmetic product on the skin by rotation of the ball.

18. The dispensing method according to claim 17, wherein when the ball occupies an upper position in which it is bearing on an upper region of the inner surface of the receiving insert, the cosmetic product flows around the ball in the upper position of the ball in the or each longitudinal channel passing through the upper region.

19. The dispensing pipette according to claim 1, wherein the or each longitudinal channel extends from one longitudinal end of the inner surface to the opposite longitudinal end of the inner surface.

* * * * *